United States Patent [19]

Bräuninger et al.

[11] Patent Number: 4,793,308

[45] Date of Patent: Dec. 27, 1988

[54] EMERGENCY CONTROL DEVICE FOR A DIESEL INTERNAL COMBUSTION ENGINE WITH ELECTRONICALLY CONTROLLED FUEL PROPORTIONING

[75] Inventors: Jürgen Bräuninger, Stuttgart; Wolfgang Dühlmeyer, Schwieberdingen; Günter Kettenacker, Steinheim; Volker Schäfer; Albrecht Sieber, both of Ludwigsburg; Jürgen Wietelmann, Hirschlanden, all of Fed. Rep. of Germany

[73] Assignee: Robert Bosch GmbH, Stuttgart, Fed. Rep. of Germany

[21] Appl. No.: 130,876

[22] PCT Filed: Nov. 5, 1986

[86] PCT No.: PCT/DE86/00445

§ 371 Date: Oct. 6, 1987

§ 102(e) Date: Oct. 6, 1987

[87] PCT Pub. No.: WO87/04759

PCT Pub. Date: Aug. 13, 1987

[30] Foreign Application Priority Data

Feb. 6, 1986 [DE] Fed. Rep. of Germany ..... 3603571

[51] Int. Cl.[4] ..... F02M 39/00

[52] U.S. Cl. ..... 123/359; 123/479; 123/198 D

[58] Field of Search ..... 123/479, 359, 358, 357, 123/198 D

[56] References Cited

U.S. PATENT DOCUMENTS

| | | | |
|---|---|---|---|
| 4,223,654 | 9/1980 | Wessel | 123/358 |
| 4,274,381 | 6/1981 | Abo | 123/479 |
| 4,378,771 | 4/1983 | Sawada | 123/479 |
| 4,428,341 | 1/1984 | Hassler | 123/359 |
| 4,502,438 | 3/1985 | Yasohara | 123/357 |
| 4,509,480 | 4/1985 | Kull | 123/359 |
| 4,528,952 | 7/1985 | Flaig | 123/198 D |
| 4,534,328 | 8/1985 | Fischer | 123/198 D |
| 4,541,380 | 9/1985 | Oshizawa | 123/479 |
| 4,730,586 | 3/1988 | Yamaguchi | 123/359 |
| 4,750,463 | 6/1988 | Peter | 123/479 |

*Primary Examiner*—Carl Stuart Miller

*Attorney, Agent, or Firm*—Michael J. Striker

[57] ABSTRACT

An emergency control device for a diesel internal combustion engine with electronically controlled fuel proportioning, which enables an optimal emergency driving operation in case of a defect of the transmitter or transmitters for the actual value of fuel volume. In the event of an error, the mechanism determining the desired value of fuel volume during normal operation, and the fuel volume regulating device, are separated from the fuel proportioning device and the latter is controlled by a special emergency driving signal. An error in the transmitters for the actual value of fuel volume is recognized in that this signal does not fall in the allowable area for the actual value of fuel volume. A first signal, which, together with a second signal, gives the emergency driving signal, is formed from the speed and the accelerator position. The second signal consists substantially of the differentiated speed signal.

15 Claims, 2 Drawing Sheets

N
25
24
23
22
21
20
10
11
50
52
53
51
55
54
15
27
Qk ist
30
29
Qk soll
S2
32
49
48
47
46
45
43
44
42
26
28
12
N,ϑ
41
40
31
S1
33
34
14
13
FFG

EMERGENCY CONTROL DEVICE FOR A DIESEL INTERNAL COMBUSTION ENGINE WITH ELECTRONICALLY CONTROLLED FUEL PROPORTIONING

BACKGROUND OF THE INVENTION

The invention relates to an emergency control device. In the known device according to DE-OS No. 31 30 094, the microcomputer and/or the controlling means can be bridged. In case of faulty operation of the signal processing unit, the position signal of the accelerator is switched more or less directly to the controlling means in order to control the controlling unit for the volume-determining member. Accordingly, an emergency driving operation is also ensured in case of faulty operation, which can be influenced, to a great extent, only by the driver of the vehicle equipped with the internal combustion engine. Moreover, an emergency control device is known from DE-OS No. 32 38 191 in which the signals of the speed transmitter, the accelerator position transmitter and the boost pressure transmitter are made use of for maintaining the emergency driving operation. The signal of the boost pressure transmitter serves primarily to place a ceiling on the required fuel quantity and, thus, to ensure a protection against overspeeding. It has been shown that an optimal emergency driving operation is not possible in many cases with the known emergency driving devices.

SUMMARY OF THE INVENTION

It is an object of the present invention to provide an improved emergency driving device for a diesel internal combustion engine.

In contrast to the prior art on which it is based, the emergency driving device, according to the invention, has the advantage that an emergency driving signal, which makes possible a stable speed control of the internal combustion engine, can be produced with relatively simple means. In the case of digital signal processing, it has the further advantage that no additional storage location is required aside from the storage location provided by the microprocessor. The device proves particularly economical because of the saving on additional electronic component parts.

A particular advantage consists in that the emergency driving signal does not depend on the manner in which the actual value of the fuel volume is determined.

Advantages also result from the manner in which the signal for the actual value of the fuel volume is monitored. A speed-dependent monitoring makes it possible to conclude in a very precise manner that there is a defective transmitter. In addition, a reverse polarity of the transmitter can be recognized immediately as a function of the fuel volume transmitter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
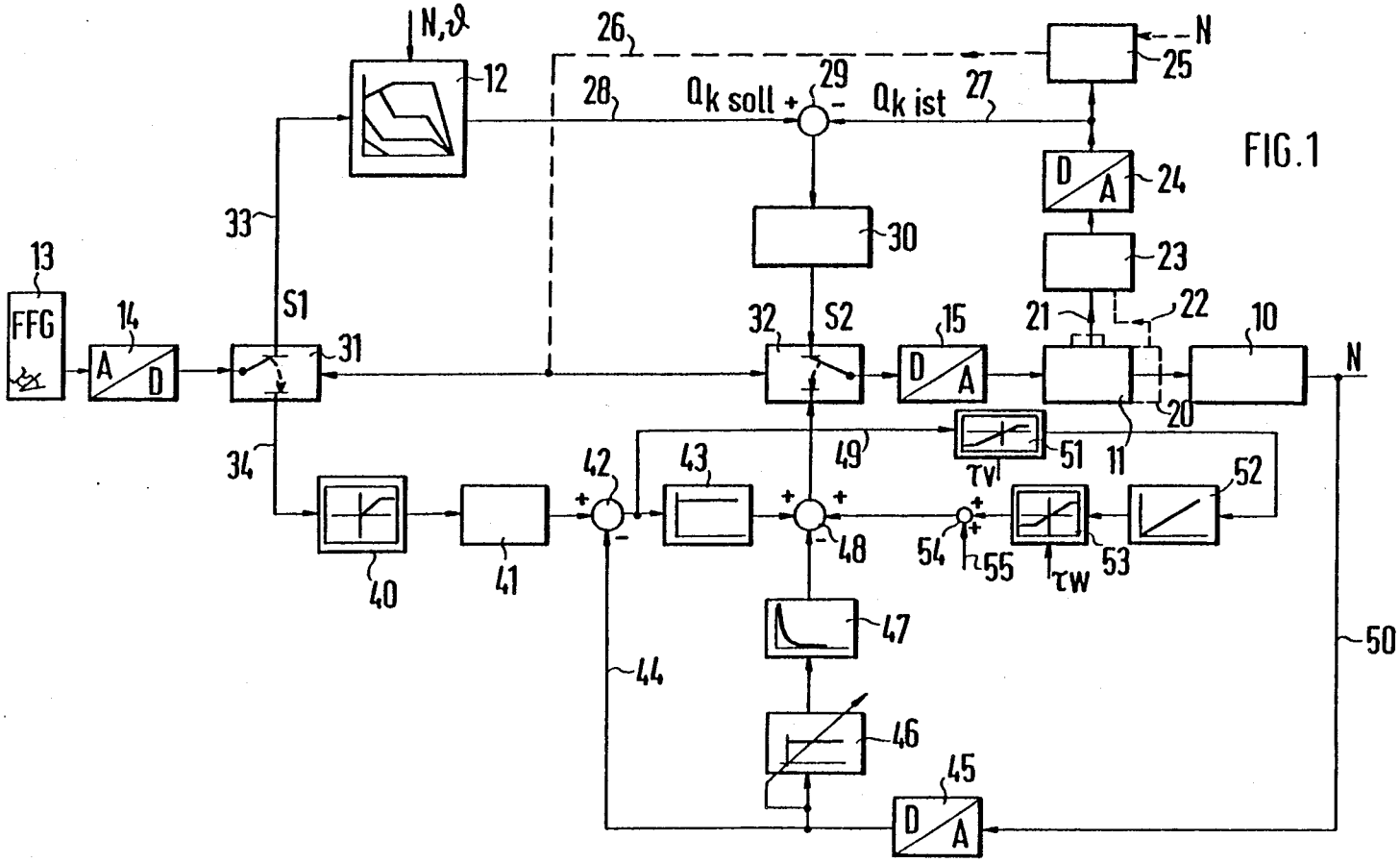
FIG. 1 shows a block wiring diagram of the emergency driving device, which shows the manner in which the emergency driving device operates.

The block wiring diagram shown in FIG. 1 concerns a diesel internal combustion engine with electronic control of the fuel supply. A drive pedal position transmitter 13 is connected with the switch 31 via an analog-to-digital converter 14. During interference-free operation the switch 31 connects the drive pedal position transmitter signal with a characteristic diagram 12 via a line 33, at least one speed signal is input in this characteristic diagram 12 as an additional variable. In the most general case, the block 12 is a computing device which, in accordance with the desired driving comfort, determines a desired value of fuel volume from the signal of the drive pedal position transmitter and signals which are dependent upon the operating parameters, such as speed, coolant temperature or battery voltage. The output of the characteristic diagram 12 is connected with an adding point 29 to which the actual value of fuel volume Qkist is fed via a line 27. The output of the adding point is fed to the fuel volume controlling means 30 which is connected in turn with a switch 32. The switch 32 connects the output of the controlling means 30 with a digital-to-analog converter 15 when there is no interference. The output of the digital-to-analog converter 15 acts on the injection pump 11 by means of an actuating member, not shown in more detail. A needle stroke transmitter 20 of an injection valve—shown in a simplified manner—is located between the injection pump 11 and the internal combustion engine 10. Alternative transmitter signal lines, which are connected with a signal processing stage 23, are designed by 21 and 22. The output of this processing stage 23 is connected to an analog-to-digital converter 24 whose output signal is connected with the line 27, on the one hand, and with the monitoring device 25 on the other hand, the latter being connected with the speed transmitter in addition. There is a working connection 26 between the monitoring device 25 and the switches 31 and 32. In the case of interference, the switch 31 is connected with a limiter 40 via the line 34. The output signal of the limiter 40 passes through a low-pass filter 41 to an adding point 42, to which a speed signal is fed via a line 44. The output signal of the adding point 42 is fed to the adding point 48 via a proportional member 43. Moreover, this signal reaches the adding point 48 via a second path consisting of the line 49, a first limiter 51, an integrator 52, a second limiter 53, and an adding point 54. A signal corresponding to the operating point of the EP is fed in the adding point 54 via a line 55. The limiters 51 and 53, proportionally acting amplifiers with limiting characteristics, are influenced by the temperature of the cooling water (or also the fuel temperature). The processed speed signal is likewise fed to the adding point via a block 46 and a differentiator 47. An analog-to-digital converter, which processes the speed signal arriving over a line 50, is designated by 45.

The embodiment of FIG. 1 shows an emergency driving device with digital signal processing. In this case, the monitoring device is realized by means of an algorithm which examines whether or not the measured fuel volume signal is located in the area which characterizes the respective operating state (see FIG. 2). Naturally, in addition to the speed signal, other operating parameters, such as temperature, air pressure or the like, can also be made use of for characterizing the operating state.

The device corresponding to FIG. 1 operates in the following manner: In normal operation, the signal coming from the drive pedal position transmitter 13 is fed to the switch 31 via the analog-to-digital converter 14. From the switch 31, it proceeds via the line 33 to the fuel volume desired value transmitter 12, to which at least the signal of the speed transmitter is fed in addition. Of course, it is also possible to adopt influencing variables such as temperature, air pressure, or the like, in the fuel volume desired value transmitter 12, as required. A desired value for fuel volume is determined in 12 as a function of the signal of the accelerator position transmitter 13 and at least the speed. This desired value is provided to the adding point 29 via the line 28. Another input variable of the adding point is the actual value of fuel volume Qkist, which is fed to the adding point via the line 27. There are a plurality of possibilities for determining the actual value of fuel volume.

Signal line 21 connects the signal of a control distance transmitter, e.g., a potentiometer, not shown in more detail, with the signal processing stage 23;

signal line 22 connects the signal of a needle stroke transmitter or a pressure sensor with the signal processing stage 23.

The signal processing stage 23 processes the signals of the fuel volume transmitter. The signals which are processed in this way are fed to the analog-digital converter 24, whose output is connected with the adding point 29, on the one hand, and with the monitoring device 25 on the other hand. In addition to the signal for the actual value of fuel volume, the speed signal N is also fed to the monitoring device 25. When an error is determined in the fuel volume transmitter, the monitoring device 25 reverses the switches 31 and 32 into the switching position, which is not shown, by means of the working connection 26. In this position, the signal of the drive pedal position transmitter 13 is connected with a limiter 40 via the line 34. The output signal of this limiter is filtered in the low-pass filter 41 and then fed to the adding point 42. The difference of the drive pedal position transmitter signal, which is filtered by means of the low-pass filter 41, and the digitized speed signal is formed in the adding point 42. A first signal is made available at the output of the adding point, which signal is given to the adding point 48 via the proportional member 43. The difference between the first signal and a second signal is formed at the adding point 48. The second signal originates from the speed signal in that the latter is fed to a device 46 in which the speed ranges are weighted differently. The output signal of this device is fed to the differentiating device 47, the second signal being provided at the output of the latter. The output signal of the adding point 48 acts as the third variable. This signal consists of two parts:

the output signal of the limiter 53, and the signal on the line 55, which signal is proportional to the operating point of the EP.

The input signal of the limiter 53 originates from a bypass integrator 52, to which the differential signal from the accelerator position transmitter and speed is fed via a limiter 51 and and the line 49. The most important element in the chain consisting of the limiter 51, the bypass integrator 52, the limiter 52 is the integrator 53 which has the object of effecting an adaptation of the operating point signal of the EP.

The two limiters 51 and 53 have different amplification factors or gains, in addition the voltage limit is a function of the coolant temperature, for example, fuel temperature. In the case of error, the switch 32 is also located in the switching position which is not shown. In this position, the output signal of the adding point 48 is connected with the digital-to-analog converter 15. Its output influences an actuating device which is not characterized in more detail but is known. This actuating device provides the injection pump 11 with the fuel volume characteristic of the respective operating state. It is noted here that a stable speed control is only possible through the inclusion of a weighted and differentiated speed signal in the control circuit for the emergency driving operation.

Figure 2:
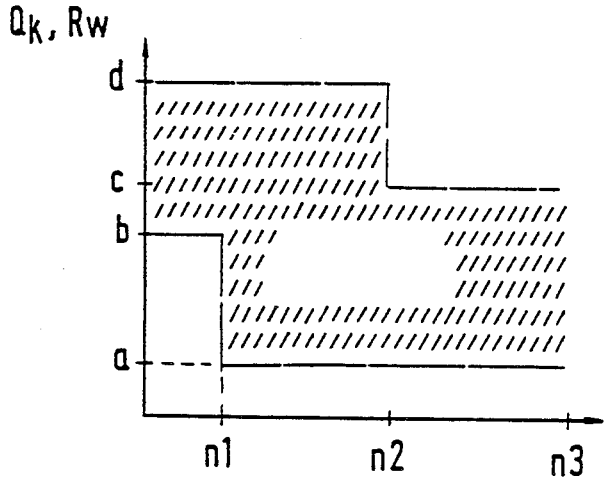
FIG. 2 shows the principle of the monitoring of the actual value of fuel volume.

In FIG. 2, the speed is plotted on the abscissa and actual value of the fuel volume is plotted on the ordinate. Three speed ranges 1, 2 and 3 and the actual value of the fuel volume a, b, c and d can be seen. The hatched area is the allowable signal range. In speed range one, from zero speed to n1 speed, the signal for the actual value of fuel volume must be located within the values b and d, within the fuel volume values a and d for speeds in the area between n1 and n2, and within the limits a and c for speeds above n2. In the warm-up phase of the internal combustion engine, that is, for coolant temperatures lower than a determined limiting temperature, an output signal between a and d is possible for a speed lower than n1. If the actual value signal signal exceeds the allowable ranges, the monitoring device 25 acts on the two switches 31 and 32 via the working connection 26, and starts the emergency driving operation.

The emergency driving device described in the embodiment of FIG. 1 works with a computer which can process exclusively digital signals. The device was split up into individual operating blocks corresponding to FIG. 1 only in order to more clearly express its manner of operation. The person skilled in the art of computers is familiar with the presentation of the functions, mostly shown by means of a block, as algorithm. However, the block wiring diagram supplies sufficient information to the person skilled in the art of diesel control to construct such an emergency driving device in a conventional (analogous) manner.

We claim:

1. Emergency control device for a diesel internal combustion engine, comprising an electronically controlled fuel proportioning device, transmitters for speed, for drive pedal position and for a volume of fuel fed to the internal combustion engine, means for determining an actual value of fuel volume from transmitter signals, means for determining a desired value of fuel volume at least from signals of the drive pedal position transmitter and the speed transmitter, means for monitoring the means for determining the actual value of fuel volume, switching devices, which in case of error in the means for determining the actual value of fuel volume, eliminate the influence of fuel volume controlling means and the desired value of fuel volume on the fuel proportioning device and connect the fuel proportioning device with an emergency control signal formed from the signals of said speed transmitter and the drive pedal position transmitter, the improvement comprises that a first signal is formed from the drive pedal position transmitter signal and the speed signal, a second signal is formed from a speed signal, which is at least weighted, and the emergency control signal is a function of a difference between the first and second signals.

2. Emergency control device according to claim 1, further including a low-pass filter for limiting and filtering the signal from the pedal drive position transmitter in the case of error.

3. Emergency control device according to claim 1, wherein the second signal is obtained from a differentiated speed signal.

4. Emergency control device according to claim 3, wherein the speed signal is weighted differently, according to a speed range, prior to differentiation.

5. Emergency control device according to claim 1, wherein the emergency control signal is influenced by a signal which is proportional to an operating point of an injection pump and a signal which adapts to the operating point of the injection pump.

6. Emergency control device according to claim 5, wherein the first signal is fed to an integrator, which acts as a bypass integrator, via a first limiting means for the purpose of adapting the operating point of the injection pump.

7. Emergency control device according to claim 6, wherein an output signal of the bypass integrator is connected with the emergency control signal via a second limiting means.

8. Emergency control device according to claim 7, wherein the first and second limiting means are dependent on the coolant temperature.

9. Emergency control device according to claim 7, wherein the first and second limiting means are dependent on the fuel temperature.

10. Emergency control device according to claim 1, wherein a range of the signal for the actual value signal of fuel volume is monitored.

11. Emergency control device according to claim 10, wherein the range of the signal for the actual value of fuel volume is monitored at speed-dependent values.

12. Emergency control device according to claim 10, wherein the signal for the actual value of fuel volume is obtained from a position of a control distance transmitter.

13. Emergency control device according to claim 10, wherein the signal for the actual value of the fuel volume is obtained from a signal of a needle stroke transmitter.

14. Emergency control device according to claim 10, wherein the signal for the actual value of the fuel volume is obtained from a signal of a pressure sensor which is exposed to a fuel pressure.

15. Emergency control device according to claim 10 wherein the signal range of the actual value for fuel volume is dependent on temperature.

* * * * *